US009131789B1

(12) United States Patent
Williams

(10) Patent No.: US 9,131,789 B1
(45) Date of Patent: Sep. 15, 2015

(54) ELONGATE JEWELRY HOLDER FOR WALL OR TABLETOP HAVING A PLURALITY OF SUBSTANTIALLY SMALLER CAPPED PEGS

(71) Applicant: Corvet Williams, Hazelcrest, IL (US)

(72) Inventor: Corvet Williams, Hazelcrest, IL (US)

( * ) Notice: Subject to any disclaimer, the term of this patent is extended or adjusted under 35 U.S.C. 154(b) by 0 days.

(21) Appl. No.: 14/012,777

(22) Filed: Aug. 28, 2013

(51) Int. Cl.

| | |
|---|---|
| ***A47F 7/02*** | (2006.01) |
| ***A47G 29/00*** | (2006.01) |
| ***A47B 43/00*** | (2006.01) |
| ***A47B 47/00*** | (2006.01) |
| ***A47B 57/00*** | (2006.01) |
| ***A47F 5/04*** | (2006.01) |

(52) U.S. Cl.
CPC .... *A47F 7/02* (2013.01); *A47F 5/04* (2013.01)

(58) Field of Classification Search
CPC ..... A47G 25/0685; A47G 25/0664; A47G 25/00; A47G 25/06; A47G 25/0671; D06F 57/04; D06F 57/08; D06F 57/12; D06F 57/02; A47B 57/06; A47B 81/00; A47B 61/003; A47B 61/02; A47B 53/00; A47B 45/00; A47B 46/00; A47B 47/00; A47B 51/00; A47F 5/04; A47F 7/00; A47F 7/02; A47F 7/19; A47F 7/24; A47F 5/106; A47F 5/05; A47F 5/10; A47F 5/06; A47F 7/022; A47F 7/024; A47F 5/0081; A47F 5/02; A47F 5/08
USPC ..... 211/85.2, 196, 205, 197, 85.9, 85.5, 211/85.1, 1.3, 85.3, 107, 166, 172, 175, 211/182; 206/6.1
See application file for complete search history.

(56) References Cited

U.S. PATENT DOCUMENTS

| | | | | |
|---|---|---|---|---|
| 1,928,292 | A * | 9/1933 | Lazarus | 211/30 |
| 3,204,779 | A * | 9/1965 | Warner | 211/190 |
| 3,264,462 | A * | 8/1966 | Haggstrom | 362/559 |
| 3,357,570 | A * | 12/1967 | Hagle, Sr. et al. | 211/125 |
| 3,464,664 | A * | 9/1969 | Nugent | 248/435 |
| 3,997,050 | A * | 12/1976 | Patterson | 206/566 |
| 4,058,356 | A * | 11/1977 | Michal | 312/305 |
| 4,889,246 | A * | 12/1989 | Lee | 211/163 |
| 4,978,001 | A * | 12/1990 | Nelson | 206/748 |
| 5,065,871 | A * | 11/1991 | Chan | 211/37 |
| 5,168,985 | A * | 12/1992 | Shih | 206/6.1 |
| D383,334 | S * | 9/1997 | Barden | D6/463 |
| 5,813,550 | A * | 9/1998 | Sheehan et al. | 211/87.01 |
| 6,443,316 | B1 * | 9/2002 | Mao | 211/74 |
| 6,698,598 | B1 * | 3/2004 | Appenteng | 211/45 |
| 7,165,689 | B2 * | 1/2007 | McDaniel | 211/165 |
| D544,164 | S * | 6/2007 | Hinkens | D32/58 |
| 2009/0065373 | A1 * | 3/2009 | Kornowski | 206/6.1 |
| 2009/0127138 | A1 * | 5/2009 | Allameh | 206/6.1 |
| 2014/0263116 | A1 * | 9/2014 | Wojciechowski | 211/85.2 |

* cited by examiner

*Primary Examiner* — Jennifer E Novosad
(74) *Attorney, Agent, or Firm* — Patent Clinic at the John Marshall Law School

(57) ABSTRACT

The present invention consists of an elongate jewelry holder having a thick central column on which may be disposed a plurality of capped pegs for holding a wide variety of jewelry. On two adjacent elongated sides are studded diagonally alternating long and short cylindrical pegs for the storage of large pieces of jewelry. On one of these adjacent elongated sides, there may be provided in the center a rectangular peg studded on each of its sides with diagonally alternating short pegs for the storage of small pieces of jewelry. On either small end of this rectangular rack are mounted planar endcaps which allow the jewelry holder to stand upright on either end or it may be mounted against a wall.

9 Claims, 2 Drawing Sheets

ELONGATE JEWELRY HOLDER FOR WALL OR TABLETOP HAVING A PLURALITY OF SUBSTANTIALLY SMALLER CAPPED PEGS

FIELD OF THE INVENTION

The present invention relates to the field of jewelry storage devices and more particularly, a costume jewelry holder for larger jewelry pieces having a thick central column with capped cylindrical pegs on at least two of its elongate sides and parallel substantially planar opposing endcaps at the distal ends of the central column.

BACKGROUND OF THE INVENTION

Currently, in the marketplace, there are available a wide variety of hanging jewelry storage units and in particular, numerous disclosures illustrate various manners for hanging articles via pegs or hooks.

For example, U.S. Pat. No. 210,023 by Mower is for a peg board that may accommodate varying sizes of pegs and may be removably secured to a wall. However, this peg board does not accommodate pegs on at least two sides of a central column and it lacks a substantially planar endcap to stand upright upon and is designed solely to be hung upon a wall.

Further, U.S. Pat. No. 5,813,550 by Sheehan describes a peg board system that may accommodate different sizes and shapes of pegs as well as pegs that may threadingly engage with one another in their opposing ends to increase or decrease peg length. However, this peg board system does not accommodate pegs on at least two sides of a central column and it lacks a substantially planar endcap to stand upright upon and is designed solely to be hung on a wall.

Similarly, in U.S. Pat. No. 6,443,316 by Mao there is described a peg board with two opposite leaning sides which may accommodate diagonally upward tilted pegs that may be removed or installed via a locking mechanism within the interior of the leaning sides of the peg board. However, this peg board is designed solely to stand upright and cannot be mounted on a wall. Further, this device is for the storage of lab equipment rather than jewelry.

Still further, in U.S. Pat. No. D510,209 by Martinelli there is described a rectangular rack with hooks built into each corner to hang objects thereupon. However, this device is designed solely to stand on its base and may not be mounted on a wall. Further, this device utilizes hooks built into the corners of the device and does not disclose the use of capped cylindrical pegs suited to displaying large costume jewelry.

Last, in U.S. Pat. No. D658,417 by Kusmer, et al., there is described an elongated rectangular jewelry rack with hanging hooks that may be removably secured onto hanging rails built into one elongated side of the rack. However, this device is designed solely to stand on its base and it cannot be mounted to a wall. Further, this device utilizes hanging hooks to display jewelry and it does not utilize cylindrical pegs suited to displaying large costume jewelry.

Thus, nowhere in the prior art is seen an elongate jewelry holder having a substantially thick central column wherein the column is disposed with a plurality of capped cylindrical pegs on at least two of its elongated sides that may be hung upon a wall or placed horizontally or stood upright via parallel substantially planar endcaps disposed at opposing distal ends of the central column.

SUMMARY OF THE INVENTION

The present invention consists of an elongate jewelry holder with a thick central column which is capped at its opposing distal ends by two parallel substantially planar endcaps. The central column may be configured in a variety of aesthetically pleasing shapes, such as cylindrical, square, rectangular, oval or elliptical, or it may even be trapezoidal or with a multiplicity of regular sides such as hexagonal, pentagonal or octagonal.

About the periphery of the central column are disposed a plurality of small capped pegs to prevent jewelry from being dislodged from the device. The capped pegs may be arranged about the central thick column in an aesthetically pleasing manner, such as in straight aligned rows, or diagonal rows, or they may even be scattered randomly about the device. These capped pegs include large capped pegs for larger jewelry items such as heavy necklaces and medium capped pegs for bracelets and light necklaces. In one preferred embodiment of the present invention, these capped pegs are provided as separate pieces from the present invention with uniformly sized bases in the capped pegs and may be installed to the user's preference. In another preferred embodiment of the invention, these pegs may be installed diagonally upward via upward sloping apertures in the sides of the central column of the present invention. In still another preferred embodiment of the present invention, on one side featuring capped pegs there is featured a rectangular peg with small capped pegs studded on its sides. These small capped pegs are designed to accommodate earrings, rings and other such small pieces of jewelry.

The parallel substantially planar endcaps at either distal end of the present invention are designed to allow the present invention to stand upright. These parallel substantially planar endcaps may also be used to hang the present invention against a wall or sit on a flat horizontal surface.

The present invention may be composed of wood, plastics, polymers, stone, fiberboard, or metals such as aluminum, steel, steel alloys, painted steels or stainless steel.

These and other variations in the design and materials of the present invention may be readily ascertained in the following description and drawings and should be considered within the overall scope of the present invention.

OBJECTS OF THE INVENTION

Thus, it is one primary object of the present invention to provide an improved elongate jewelry holder with at least some larger pegs for the purpose of storing larger jewelry, such as necklaces, by hanging such jewelry onto the larger pegs incorporated onto the sides of the thick central column of the present invention.

It is another primary object of the present invention to provide an improved elongate jewelry holder with at least some smaller pegs for the purpose of storing smaller jewelry, such as bracelets, by hanging such jewelry onto the smaller pegs incorporated onto the sides of the thick central column of the present invention.

It is still another primary object of the present invention to provide an improved elongate jewelry holder with at least some still smaller pegs for the purpose of storing still smaller jewelry, such as earrings, by hanging such jewelry onto the still smaller pegs incorporated onto the sides of a rectangular peg which is in turn installed onto one of the sides of the thick central column of the present invention.

It is still another primary object of the present invention to provide an improved elongate jewelry holder with parallel planar endcaps having at least one flat edge on each opposing distal end of the thick central column so the present invention may be mounted against a wall.

Finally, it is a primary object of the present invention to provide an improved elongate jewelry holder with parallel planar endcaps at the distal ends of the thick central column so the present invention may be stood upright upon either endcap on a horizontal surface.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
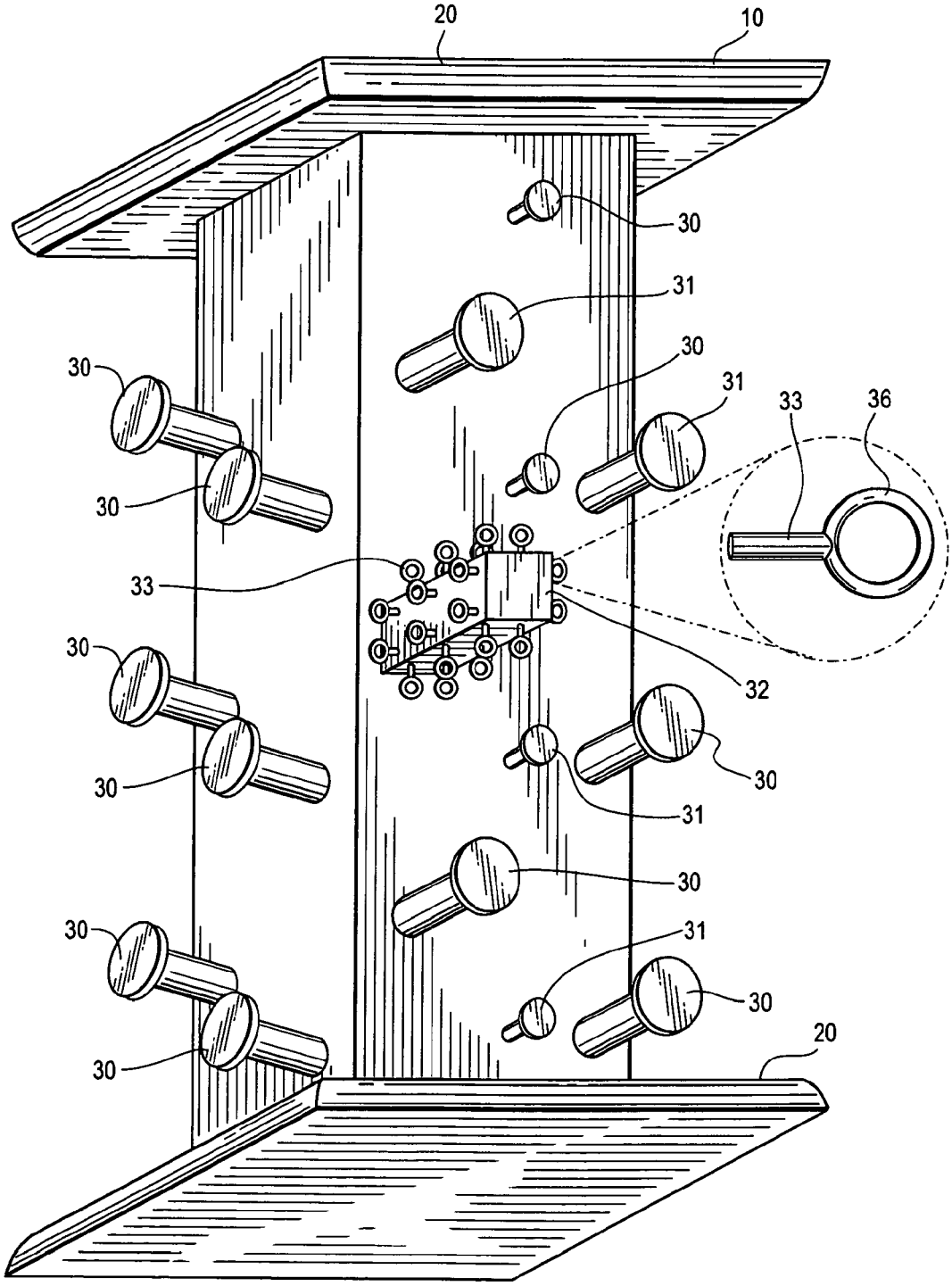
FIG. 1 is a raised perspective view of the present invention standing upright on one of its parallel substantially planar sides, with capped pegs of varying sizes installed on its central column.

Shown now in FIG. 1 is a bottom perspective view of one embodiment of the present invention, the Cylindrical Elongate Jewelry Holder 10. The Cylindrical Elongate Jewelry Holder 10 may be composed of wood, plastics, polymers, stone, fiberboard, or metals such as aluminum, aluminum alloy, steel, steel alloys, painted steels or stainless steel. The substantially planar endcaps 20 are used to support the Elongate Jewelry Holder 10 in its upright or vertical position. The substantially planar endcaps 20 may also be fixed against a wall by means of screws, nails or hooks to allow the Elongate Jewelry Holder 10 to hang upon a wall. On the sides of the central column 40 of the present invention are provided large capped pegs 30 for storage of large jewelry such as necklaces and large bracelets, as well as medium capped pegs 31 for the storage of smaller jewelry such as small bracelets and large rings, as well as a rectangular peg 32 which has been studded with very small pegs with end rings 33 for the storage of the smallest jewelry items such as earrings and small rings. The blown apart portion of this drawing shows how the very small pegs 33 are provided each with an end ring which allows for removable securement of pierced earrings.

Figure 2:
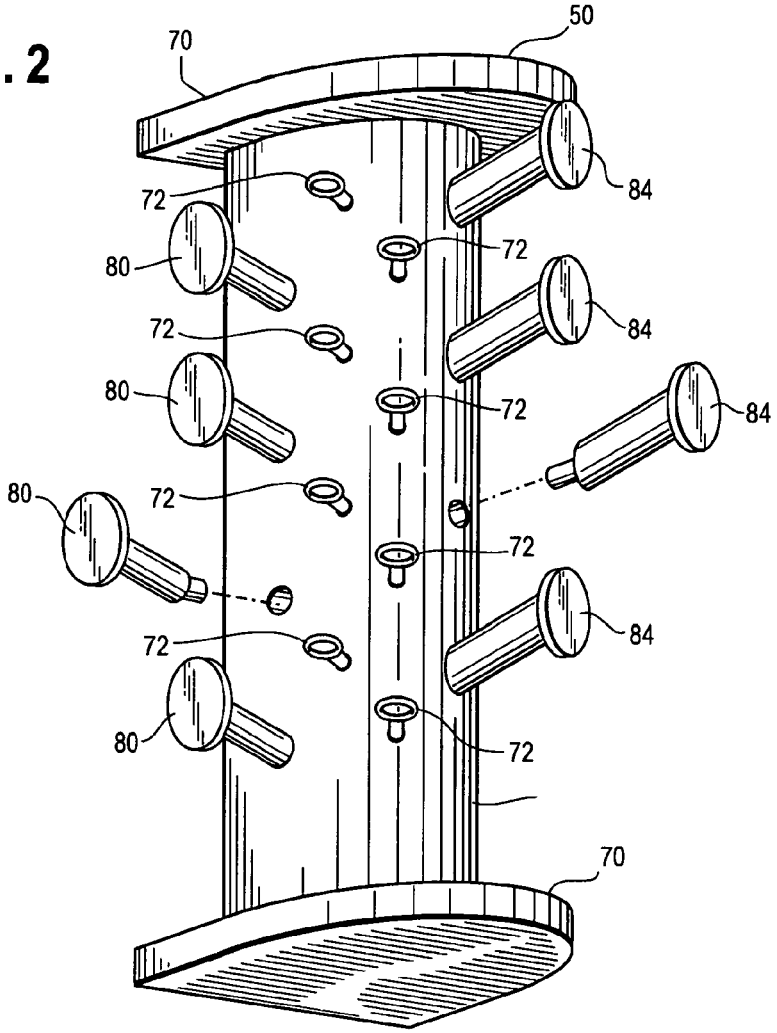
FIG. 2 is a raised perspective view of the present invention standing upright on one of its parallel substantially planar sides having capped pegs of varying sizes installed on its central column, including diagonally installed large capped pegs.

Shown now in FIG. 2 is an additional preferred embodiment of the present invention, Semi-Elliptical Elongate Jewelry Holder 50, which is shown in a bottom perspective view. The Semi-Elliptical Elongate Jewelry Holder 50 may be composed of wood, plastics, polymers, stone, fiberboard, or metals such as aluminum, aluminum alloy, steel, steel alloys, painted steels or stainless steel. The semi-elliptical endcaps 70 are used to support the Semi-Elliptical Elongate Jewelry Holder 50 in its upright position when in use on a table or other flat horizontal surface and the semi-elliptical design provides an aesthetically pleasing appearance. The semi-elliptical substantially planar endcaps 70 may also be fixed against a wall by means of screws, nails or hooks to allow the Semi-Ellipitical Elongate Jewelry Holder 50 to hang upon a wall or other vertical surface. A keyhole or loop may be commonly used to hand the Semi-Elliptical Elongate Jewelry Holder 50 upon a wall or other vertical surface. On the sides of the central column 40 of this embodiment of the present invention are large capped pegs 80 for the storage of larger jewelry items such as necklaces and large bracelets; small capped pegs 72 which may be for the storage of smaller jewelry such as bracelets and rings. Further, diagonal large capped pegs 84 may be utilized for the storage of large jewelry such as necklaces, bangles and bracelets, with the added benefit of the diagonal installation of the large capped pegs 84 to prevent the jewelry items from sliding off the ends of the pegs when in use. These are all but a few examples of the different types of pegs which can be utilized in conjunction with the substantially thick columnar portion of the present invention.

Figure 3:
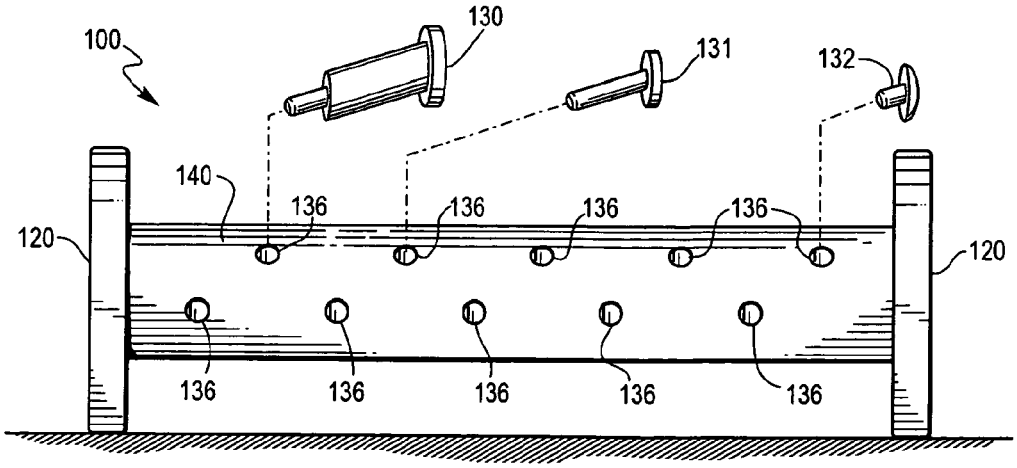
FIG. 3 is an elevational blown apart plan view of one side of the present invention depicting peg placement of various sized pegs.

Shown now in FIG. 3 is an additional preferred embodiment of the present invention, Elongate Jewelry Holder with Detachable Pegs 100 which is shown in an elevated plan view positioned horizontally, as it might be used on top of a table, dresser or other horizontal surface. The Elongate Jewelry Holder With Detachable Pegs 100 may be composed of wood, plastics, polymers, stone, fiberboard, or metals such as aluminum, aluminum alloy, steel, steel alloys, painted steels or stainless steel. The substantially planar endcaps 120 may also be fixed against a wall by means of screws, nails or hooks to allow the Elongate Jewelry Holder With Detachable Pegs 100 to hang upon a wall or other vertical surface. On the sides of the central column 140 are peg apertures 136 which may be used to install either large capped pegs 130 for the storage of large jewelry or small capped pegs 131 for the storage of small jewelry or the user may elect to use cap covers 132 when the peg apertures 136 are not in use.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A jewelry holder comprising:

a first asymmetrical panel and a second asymmetrical panel, wherein both asymmetrical panels have a resting surface;

a central column disposed between the first asymmetrical panel and the second asymmetrical panel;

wherein the first asymmetrical panel and the second asymmetrical panel are disposed on distal ends of the central column; and wherein the holder is adapted to be disposed in two different positions whereby in a first one of the positions the resting area of the first asymmetrical panel and the resting area of the second asymmetrical panel rest on a horizontal surface and in a second one of the positions the resting area of the first asymmetrical panel and the resting area of the second asymmetrical panel rest against a vertical surface, whereby when placed in either of the two positions, the surface on which the holder rests is parallel to an axis of the central column;

the central column containing a plurality of openings therein receiving a plurality of removable pegs of different sizes, wherein each of the plurality of removable pegs comprises a cap portion and a body portion;

wherein at least a portion of said body portion of each of the plurality of removable pegs fits inside said each of the plurality of openings on the central column; and wherein the body portion of the plurality of removable pegs is non-threaded.

2. The jewelry holder in claim 1, wherein the first end, the second end, and the central column are made out of at least one of the following materials: wood, a polymer, aluminum, steel, stainless steel, steel alloy and aluminum alloy.

3. The jewelry holder in claim 1, wherein the plurality of removable pegs disposed on the central column have varying lengths from about 0.5 to 10 inches.

4. The jewelry holder in claim 1, wherein the plurality of removable pegs disposed on the central column have varying circumferences between about 0.1 to 1 inches.

5. The jewelry holder in claim 1, wherein the central column comprises at least one of the following shapes: cylindrical, hemi-elliptical, spherical, and polyhedral.

6. The jewelry holder in claim 1, wherein the plurality of removable pegs includes at least one cubic peg including a cap portion and a body portion, the cap portion comprises a column having one or more openings for receiving additional pegs, wherein the body portion fits inside said each of the plurality of openings on the central column.

7. The jewelry holder in claim 1, wherein the first asymmetrical panel or the second asymmetrical panel is disposed for attachment to the vertical surface.

8. A jewelry holder comprising:

a first panel and a second panel, where said panels are horizontally disposed; a central column disposed between the first panel and the second panel;

wherein the first panel and the second panel are disposed on the distal ends of the central column;

the central column having a plurality of openings therein receiving a plurality of removable pegs of different sizes, wherein each of the plurality of removable pegs comprises a cap portion and a body portion;

wherein the plurality of removable pegs includes at least one cubic peg including a cap portion and a body portion;

wherein the body portions of each of the removable pegs and the at least one cubic peg are each of a same size and substantially match a size of each of the openings in the central column;

wherein the cubic peg projects outwardly from the central column in a cantilevered manner, whereby the cap portion of the cubic peg comprises additional openings receiving additional pegs;

wherein the body portion of each of the removable pegs and the at least one cubic peg fits inside said each of the plurality of openings on the central column; and wherein the body portion of the plurality of removable pegs and the at least one cubic peg is non-threaded.

9. The jewelry holder in claim 8, wherein the first and second panels are disposed for attachment to a wall.

* * * * *